United States Patent [19]

Gomi et al.

[11] Patent Number: 4,554,148

[45] Date of Patent: Nov. 19, 1985

[54] PROCESS FOR THE PREPARATION OF CARBON FIBERS

[75] Inventors: Shimpei Gomi, Tokyo; Tomio Arai, Zushi; Fumio Mogi, Tokyo; Kunio Miura, Chiba; Sugio Otani, Kiryu, all of Japan

[73] Assignee: Fuji Standard Research, Inc., Japan

[21] Appl. No.: 611,152

[22] Filed: May 17, 1984

[30] Foreign Application Priority Data

May 20, 1983 [JP] Japan ..... 58-88775

[51] Int. Cl.[4] ..... D01F 9/12

[52] U.S. Cl. ..... 423/447.1; 423/447.4; 423/447.8; 264/29.2; 208/40

[58] Field of Search ..... 423/447.1, 447.4, 447.5, 423/447.6, 447.7, 447.8; 264/29.2, 29.3, 29.6, 29.7; 208/44, 40

[56] References Cited

U.S. PATENT DOCUMENTS

| | | | |
|---|---|---|---|
| 4,032,430 | 6/1977 | Lewis | 423/447.1 |
| 4,243,512 | 1/1981 | Seo | 423/447.1 |
| 4,271,006 | 6/1981 | Dickakian | 208/40 |

*Primary Examiner*—John Doll
*Assistant Examiner*—Robert M. Alway
*Attorney, Agent, or Firm*—Pahl, Lorusso & Loud

[57] ABSTRACT

A process for the preparation of carbon fibers, including the steps of:

subjecting a raw material oil to thermal cracking conditions at a temperature of between 400° to 500° C. while removing cracked, light hydrocarbon components to obtain a pitch product containing at least 5 weight % of mesophase and not more than 10 weight % of light hydrocarbon components with a boiling point at 60 mmHg (absolute) of 300° C. or less and having a softening point of between 140° and 220° C., the raw material oil having a boiling point of at least 500° C. and containing at least 30 weight % of a residual oil which has a boiling point of at least 500° C. and a metal content of at least 200 weight ppm and which is derived from a napthene base and/or intermediate base petroleum crude;

removing the mesophase having a particle size of more than 10 μm from the pitch product to obtain a substantially mesophase-free carbonaceous pitch;

spinning the substantially mesophase-free pitch into fibers;

rendering the spun fibers infusible; and carbonizing the infusible fibers.

4 Claims, No Drawings

PROCESS FOR THE PREPARATION OF CARBON FIBERS

BACKGROUND OF THE INVENTION

This invention relates to a process for the preparation of carbon fibers.

As carbon fibers are increasingly applied in many fields, an attempt is now being made to use then for incorporation into bodies of plastics, ceramics, concrete and metals. As precursor materials for carbon fibers, polyacrylonitrile fibers have been hitherto employed. Since the carbon fibers obtained from polyacrylonitrile fibers are expensive, however, a number of studies have been made in recent years to utilize relatively inexpensive carbonaceous pitch as raw materials for carbon fibers.

The general method for the production of carbon fibers from carbonaceous pitch includes melt spinning pitch into fibers, rendering the spun fibers infusible, and carbonizing the infusible fibers. To smoothly perform such a method, the properties of the raw material pitch are very important. The most important requirement is that the pitch must have a good spinnability. It is also important that the pitch must have properties so that the spun fibers obtained therefrom may be rendered infusible and carbonized without difficulty. Pitch which can meet with the above criteria has been hitherto considered to be of a type which is obtained by carefully thermally treating a raw material oil, such as a naphtha cracking residue, a recycle oil in fluidized bed catalytic cracking processes or a coal tar, which has a high content of aromatic components and a low content of impurities such as metals, inorganic matters and sulfur components. Thus, pitch derived from a low grade oil such as a vacuum residue or an atmospheric distillation residue has been considered to be unsuitable for use as a raw material pitch for the production of carbon fibers, since such a pitch has a poor spinnability. Since the high grade raw material oils described above are relatively expensive and fail to give pitch with a high yield, the carbon fibers obtained therefrom are also expensive. Therefore, there is a great demand for a process which can produce carbon fibers at a low cost.

SUMMARY OF THE INVENTION

The present invention provides a process for the preparation of carbon fibers, which comprises the steps of:

subjecting a raw material oil to thermal cracking conditions at a temperature of between 400° and 500° C. while removing cracked, light hydrocarbon components to obtain a pitch product containing at least 5 weight % of mesophase and not more than 10 weight % of light hydrocarbon components with a boiling point at 60 mmHg (absolute) of 300° C. or less and having a softening point of between 140° and 220° C., the raw material oil having a boiling point of at least 500° C. and containing at least 30 weight % of a residual oil which has a boiling point of at least 500° C. and a metal content of at least 200 weight ppm and which is derived from a naphthene base and/or intermediate base petroleum crude;

removing the mesophase having a particle size of more than 10 μm from the pitch product to obtain a substantially mesophase-free carbonaceous pitch;

spinning the substantially mesophase-free pitch into fibers;

rendering the spun fibers infusible; and carbonizing the infusible fibers.

One of the features of the present invention resides in the use of a raw material oil containing at least 30 weight % of a residual oil which has a boiling point of 500° C. or more and which is derived from a naphthene base and/or intermediate base petroleum crude. Such a raw material oil contains a large amount of asphaltenes and impurities such as heavy metals and is a very low grade, heavy residual oil the use of which has been avoided for the production of carbon fibers.

However, it has now been found that in the case of using the naphthene base or intermediate base raw material oil, dehydrogenation, thermal decomposition and other reactions resulting in the formation of pitch proceed faster as compared with the case of using a residual oil derived from paraffin base petroleum crude. Therefore, the reaction time of the thermal cracking can be advantageously reduced. The use of the specific low grade raw material oil has been unexpectedly found to have an additional merit that the pitch product obtained therefrom has a good thermal stability. Therfore, during the pitch forming, thermal cracking stage and during the subsequent spinning stage, the occurrence of coking is minimized.

Furthermore, it has been found that the removal of the mesophase from the mesophase pitch obtained by thermally cracking the naphthene base or intermediate base raw material oil can be effected easily by filtration. When such a raw material oil is subjected to thermal cracking conditions according to the process of the present invention, a multiplicity of anisotropic small spheres (mesophase) having a particle size of 10 μm or less, generally between 1 and 5 μm, are formed at a relatively early stage of the reaction. Even with an increase in reaction time, the mesophase small spheres grow very sparingly in size and tend to aggregate, without coalescing with each other, to form botryoidally aggregated pitch particles having a particle size of 20–150 μm with each of the pitch spheres retaining its original spherical form. The botryoidal pitch particles, which are homogeneously dispersed within the matrix of the isotropic pitch, are easily separated by filtration from the matrix at an elevated temperature, for example at a temperature of between 250° and 400° C. The mesophase, which has a higher softening point than the isotropic matrix, exhibits solid-like behaviors at such a filtration temperature.

The substantially mesophase-free carbonaceous pitch obtained as a filtrate is very thermally stable. When the pitch is heated above its melting point, no mesophase is newly formed. Fine mesophase particles which have a particle size of 10 μm or less, which have failed to be removed during the filtration step and which may trace be present in the filtrate never grow in size to the extent that they adversely affect the spinnability of the pitch. Further, the amount of the low molecular weight components in the carbonaceous pitch is small and the molecular weight of the pitch is distributed in relatively high and narrow range. Thus, the carbonaceous pitch has all the properties necessary for use as precursor materials for the production of carbon fibers.

It is, therefore, an object of the present invention to provide a process by which carbon fibers can be prepared at a low cost.

Other objects, features and advantages of the present invention will become apparent from the detailed description of the present invention to follow.

DETAILED DESCRIPTION OF THE INVENTION

The raw material oil used in the process of the present invention is an oil having a boiling point of at least 500° C. and containing at least 30 weight % of a residual oil which has a boiling point of 500° C. or more and which is derived from a naphthene base and/or intermediate base petroleum crude. The terms "naphthene base petroleum crude" and "intermediate base petroleum crude" used herein are defined by UOP characterization factor classification method as crude oil having chracterization factor K of between 11.0 and 11.5 and between 11.5 and 12.0, respectively. The characterization factor K is expressed by:

$$K = \sqrt[3]{T_B}/S$$

where $T_B$ stands for a molar average boiling point in terms of Rankine temperature (°F.+460) and S stands for a specific gravity at 60° F. of the distillate. Illustrative of suitable naphthene base crude oils are California crude, Coalinga crude, Texas crude, Bachaquero crude, Merey crude, Boscan crude, Maya crude, Klamono crude, Seria crude and Nigeria crude. Illustrative of suitable intermediate base crude oils are Iranian Heavy crude, Murban crude, Sassan crude, Dovai crude, Mid-continent crude and North slope crude.

The term "residual oil from naphthene base or intermediate base petroleum crude" is intended to mean a heavy fraction, such as an atmospheric residue, a vacuum residue, a vacuum distillate or asphalt from a solvent deasphalting process, having a boiling point of 500° C. or more. The asphalt from a solvent deasphalting process is that obtained by subjecting a residual oil such as an atmospheric residue to extraction treatment using as an extraction solvent propane, butane, pentane, etc.

A residual oil containing at least 200 ppm, preferably at least 500 ppm of metal components such as nickel and vanadium is used for the purpose of the present invention. Residual oils having a large residual carbon content (Conradson carbon residue) and/or a large amount of sulfur components may be used for the purpose of the present invention. The use of a residual oil having a large amount of residual carbon is rather preferred since the yield of pitch becomes higher with the increase of the residual carbon content. The above-described residual oils generally belong to poor grade heavy hydrocarbon oils and have been regarded as being unsuited for the production of carbon fibers.

If desired, the raw material oil can contain other residual oils, such as those derived from Arabian crude, Arabian Heavy crude, Kuwait crude, Oman crude and the like crude, than those derived from naphthene base or intermediate base petroleum crude. The content of the residual oil derived from naphthene base and/or intermediate base petroleum crude in the raw material oil should be 30 weight % or more, preferably 50 weight % or more.

When the content of the residual oil derived from naphthene base or intermediate base petroleum crude is below 30 weight % or when the content of metals in the raw material oil to be thermally cracked is below 200 weight ppm, the rate at which the pitch is formed becomes low. The resulting pitch is not thermally stable and coking is liable to occur during the thermal cracking step. Further, the mesophase spheres tend to coalesce with each other to form large mesophase particles which are unevenly distributed in the matrix of isotropic pitch and are very difficult to separate from the matrix by filtration in the molten state. In addition, the fine particles of mesophase contained in the filtrate can coalesce with each other to form large mesophase particles which adversely affect the spinnability of the pitch.

The raw material oil is thermally cracked, while removing, generally continuously, cracked light hydrocarbons, at a temperature of between about 400° and 500° C., preferably between 410° and 440° C. so that a pitch is formed by polycondensation and other reactions inherent to the thermal cracking. It is preferred that the removal of the cracked light hydrocarbon products be conducted by maintaining the reaction zone under a reduced pressure for the evaporation of the light hydrocarbons formed by the thermal cracking or by continuously feeding a gaseous heat transfer medium to the reaction zone for contact with the raw material oil. The heat transfer medium serves both to supply heat necessary for effecting the thermal cracking and to strip volatile cracked products and is preferably a substantially oxygen-free, non-oxidative gas such as steam, a hydrocarbon gas or vapor, a perfect combustion waste gas, a nitrogen gas or a hydrogen gas.

The thermal cracking is performed in a liquid phase under a reduced pressure, generally at a pressure of between 100 and 500 mmHg (absolute) or under a partial pressure of hydrocarbon vapor of between 100 and 500 mmHg. The reaction time is generally in the range of between 0.3 and 10 hours, though the reaction time varies according to the kind of the raw material oil to be thermally cracked. The thermal cracking may be carried out with the use of any know liquid phase cracking reactors in a continuous, batch or semi-batch mode.

The thermal cracking is conducted so that the pitch product contains at least 5 weight %, generally between 5 and 40 weight %, preferably between 10 and 25 weight % of mesophase and not more than 10 weight %, preferably not more than 5 weight % of light hydrocarbon components with a boiling point at 60 mmHg (absolute) of 300° C. or less and has a softening point of between 140° and 220° C., preferably between 160° and 190° C.

It is important that the thermal cracking should be conducted at a temperature and for a period of time so that at least 5 weight % of mesophase is formed. If the thermal cracking is stopped before the formation of mesophase, the molecular weight of the resulting pitch is too small to give spun fibers of a satisfactory strength. The formation of at least 5 weight % of mesophase is necessary to obtain a pitch suitable for spinning into fibers.

The content of the light fraction is also important for the pitch to have a suitable spinnability. The content of light hydrocarbon components above 10 weight % is disadvantageous because the pitch fibers tend to be broken during spinning and because it becomes difficult to render the spun fibers infusible. The content of the light hydrocarbon components in the pitch can be controlled by adjusting the feed rate of the gaseous heat transfer medium or the degree of vacuum pressure during the cracking step.

When the softening point of the pitch product is below 140° C., the stability of the carbonaceous pitch obtained by the removal of the mesophase therefrom becomes poor and it becomes also difficult to render the spun fibers infusible. A softening point of the pitch product above 220° C. is also undesirable because the pitch product will have a greater amount of mesophase, resulting in the decrease in yield of the carbonaceous pitch. Too high a softening point also makes the spinning operation difficult to perform. The term "softening point" used in the present specification is measured by means of a Koka-type flow tester manufactured by Shimadzu Seisakusho Co., Ltd. and is a temperature at which the sample commenced to flow through a nozzle having a diameter of 1 mm when heated at a rate of 6° C./min under a pressure of 10 $Kg/cm^2$.

The thus obtained pitch product containing mesophase dispersed in the matrix of isotropic pitch is then subjected to a solid-liquid separation treatment for the removal of the mesophase and to obtain substantially mesophase-free carbonaceous pitch. The term "substantially mesophase-free" herein is intended to mean that the pitch contains no mesophase having a particle size of 10 μm or more. Mesophase particles having a particle size of less than 10 μm do not adversely affect the spinnability of the carbonaceous pitch and, therefore, the presence of such fine mesophase particles in the carbonaceous pitch can be ignored for the purpose of the present invention. A polarized light microscopy reveals that the mesophase contained in the pitch product has a mosaic structure composed of very fine particle units having a diameter of between 1 and 5 μm. The fine particle units aggregate during the thermal cracking to form botryoidal, aggregared particles with a size of between 25 and 150 μm homogeneously dispersed in the matrix of isotropic pitch. Under the reaction conditions, the mesophase particles or their aggregated particles do not coalesce with each other. Therefore, at a temperature above the melting point of the isotropic matrix but below the softening point of the mesophase, generally at a temperature of between 250° and 400° C., the mesophase can be easily separated by filtration in the form of a cake.

As described previously, the formation of such easily separable mesophase is considered to be ascribed to the use of the specific raw material oil having a large amount of metals such as vanadium and nickel. In comparison with the pitch obtained in the same manner as the method of the present invention by thermal cracking of a residual oil derived from paraffin base petroleum crude, the mesophase pitch particles or their aggregated particles obtained in accordance with the present invention have a relatively small particle size and are homogeneously dispersed in the matrix of isotropic pitch which, in molten state, has relatively a high viscosity. On the other hand, the mesophase obtained from the paraffin base petroleum crude has a large particle size, generally of between 200 and 1000 μm and does not form a cake when filtered. If the mesophase is forced to be separated by filtration, then the filtrate will contain mesophpase particles having a particle size of 30 μm or more as well as fine mesophase particles. Thus, it is not possible to obtain a substantially mesophase-free carbonaceous pitch by filtration of the pitch product obtained from the paraffin base petroleum crude.

The mesophase separated by filtration from the pitch product contains a large amount of quinoline insolubles and, further, a larger amount of nickel, vanadium and other metal components than the filtrate. The metal components contained in the raw material oil are caught by or bound to mesophase, such as in the form of organo-metallic salts or porphyrin complexes, to form fine, quinoline insoluble-rich, higher softening point (than the isotropic matrix), solid-like mesophase particles. Thus, it is believed that metal components contained in the raw material oil contribute to the good separability of the mesophase formed in accordance with the method of the present invention.

The removal of mesophase from the pitch product may be suitably performed by filtration, by application of a pressure or under reduced pressure, at an elevated temperature. Other solid-liquid separation methods such as centrifuge and sedimentation may also be used. As described previously, the presence of mesophase particles having a diameter of less than 10 μm does not adversely affect the subsequent spinning operation, oxidation treatment for rendering the spun fibers infusible and carbonizing treatment. Therefore, it is not necessary to remove such a fine mesophase particles. However, it is of course desirable to remove as much mesophase as possible. It is preferred that the carbonaceous pitch do not contain mesophase particles having a diameter of 5 μm or more. Generally, the filtrate obtained by the removal of mesophase contains about 2 weight % or less of fine mesophase particles.

The substantially mesophase-free carbonaceous pitch is then spun into fibers at a temperature of between 200° and 280° C. at a high spinning rate in any known manner. The spun fibers are heat-treated, generally at a temparature of up to 300° C., in the conventional manner in the oxidizing atmosphere such as in the atmosphere of air or $NO_2$-containing air for rendering the spun fibers infusible. The infusible fibers are then carbonized in the conventional manner, generally at a temperature of 800° C. or more, to obtain carbon fibers which exhibit both a high tensile strength and a high modulus as compared with the conventional isotropic pitch.

The following example will further illustrate the present invention.

EXAMPLE 1

A mixed oil having the formulation shown in Table 1 was distilled at atmospheric pressure and the bottom was subjected to vacuum distillation to obtain a residual oil having a boiling point of above 538° C. with a yield of 34 volume %.

TABLE 1

| Formulation of Mixed Oil | |
|---|---|
| Crude Oil | Content (vol. %) |
| Iranian Heavy | 47 |
| Bachaquero | 33 |
| Maya | 12 |
| Arabian Light | 7 |

When each of the crude oils was subjected to the similar two stage distillation treatment, the yield and the properties of the resultant residual oil having a boiling point of above 538° C. were as shown in Table 2. From the results shown in Tables 1 and 2, the residual oil obtained from the mixed oil is considered to have the composition shown in Table 3.

TABLE 2

| Yield and Properties of Residual Oil | Iranian Heavy | Bachaquero | Maya | Arabian Light |
|---|---|---|---|---|
| Yield (vol. %) | 25.8 | 45.3 | 41.5 | 18.4 |
| Specific gravity (25/25° C.) | 1.017 | 1.02 | 1.046 | 0.997 |
| Conradson carbon residue (wt %) | 19.7 | 21.6 | 24.8 | 19.2 |
| Sulfur content (wt %) | 3.42 | 3.37 | 5.38 | 4.15 |
| Nickel content (wt ppm) | 94 | 98 | 130 | 19.9 |
| Vanadium content (wt ppm) | 241 | 748 | 564 | 79 |

TABLE 3

| Composition of the Residual Oil from the Mixed Oil | Content | |
|---|---|---|
| Residual oil | vol % | wt % |
| Iranian Heavy | 36.4 | 36.2 |
| Bachaquero | 44.8 | 44.7 |
| Maya | 14.9 | 15.2 |
| Arabian Light | 3.9 | 3.9 |

One Kg of the residual oil obtained from the mixed oil was thermally cracked in a 2 liter autoclave equipped with an agitator at a temperature of 425° C. and a pressure of 1.1 Kg/cm$^2$ (absolute) to obtain 5 weight % of cracked gases, 60 weight % of cracked oils and 33 weight % of pitch. The thermal cracking was performed while continuously feeding about 1 g/min of superheated steam to the autoclave while maintaining the partial pressure of hydrocarbon vapor in the autoclave at 300 mmHg. The pitch had the properties shown in Table 4.

TABLE 4

| Properties of Pitch | | |
|---|---|---|
| Softening point | (°C.) | 183 |
| Volatile matters | (wt %) | 42.0 |
| Content of fraction boiling at below 300° C. at 60 mm Hg (absolute) | (wt %) | below 1 |
| Metal content (V and Ni) | (wt ppm) | 1540 |
| Sulfur content | (wt %) | 5.35 |
| n-Heptane insolubles | (wt %) | 78.6 |
| Quinoline insolubles | (wt %) | 20.0 |

Polarized light microscopy of the pitch revealed the presence of fine mesophase particles in the mosaic structure. The fine particles having a diameter of 1-6 μm were found to form botryoidal, aggregated particles having a diameter of 50-100 μm homogeneously dispersed in the pitch. The mesophase content was about 25% when determined by polarized light microscopy. The pitch had a viscosity of 5500 cp (at 325° C.) when measured by a rotary viscosimeter.

100 g of the pitch was heated to 300° C. in the atmosphere of nitrogen and filtered using 500 mesh metal sieve having an effective area of 25 cm$^2$ under reduced pressure of 10 mmHg (absolute), whereby to obtain 50 g of a filtrate having a viscosity of 2400 cp (at 325° C.). The solids phase (mesophase) separated formed a cake with a thickness of about 10 mm on the metal sieve. The separation by filtration was able to be carried out smoothly and easily. The filtrate was found to contain almost no mesophase having a diameter of 5 μm or more as a result of polarized light microscopic observation. The filtrate was substantially isotropic in nature and had a softening point of 179° C., a volatile matter content of 43.8 weight %, a quinoline insoluble content of 0.8 weight % and a metal content (V and Ni) of 1200 weight ppm. The cake on the metal sieve had a mesophase content of about 80 weight %, a softening point of 260° C., a volatile matter content of 35.1 weight %, a quinoline insoluble content of 58.5 weight % and a metal conent (V and Ni) of 1990 weight ppm.

The filtrate was then spun into fibers through a nozzle having a nozzle diameter of 0.3 mm and a L/D ratio of 3. The spinning was performed at a spinning temperature of 235° C., a spinning pressure of 1.8 Kg/cm$^2$ and a spinning rate of 100 m/min. The spun fibers had a diameter of about 20 μm and were thermally stable. The spun fibers were then heated in the air from 140° to 180° C. at a heating rate of 20° C./hour. The fibers were subsequently heated to 250° C. at a heating rate of 1° C./min and maintained at that temperature for 10 min so that the fibers were rendered infusible. The infusible fibers were heated at a rate of 5° C./min to 1000° C. and maintained at that temperature for 10 min to obtain carbon fibers having a diameter of 16 μm, a tensile strength of about 9 ton/cm$^2$, a modulus of 600 ton/cm$^2$ and an elongation of 1.3%. The yield of the carbon fibers was about 75 weight % based on the pitch.

EXAMPLE 2

A mixed oil having the formulation shown in Table 5 was distilled at atmospheric pressure and the bottom was subjected to vacuum distillation to obtain a residual oil having a boiling point of above 538° C. with a yield of 20 volume %.

TABLE 5

| Formulation of Mixed Oil | |
|---|---|
| Crude Oil | Content (vol %) |
| Arabian Light | 50 |
| Iranian Heavy | 20 |
| Oman | 20 |
| Murban | 10 |

When each of the crude oils was subjected to the similar two stage distillation treatment, the yield and the properties of the resultant residual oil having a boiling point of above 538° C. were as shown in Table 6. From the results shown in Tables 5 and 6, the residual oil obtained from the mixed oil is considered to have the composition shown in Table 7.

TABLE 6

| Yield and Properties of Residual Oils | Arabian Light | Iranian Heavy | Oman | Murban |
|---|---|---|---|---|
| Yield (vol %) | 18.4 | 25.8 | 19.0 | 10.4 |
| Specific gravity (25/25° C.) | 1.031 | 1.02 | 0.9729 | 0.9784 |
| Conradson carbon residue (wt %) | 19.2 | 19.7 | 13.8 | 15.3 |
| Sulfur content (wt %) | 4.15 | 3.42 | 2.04 | 2.40 |
| Nickel content (wt ppm) | 19.9 | 94 | 33.6 | 8.3 |
| Vanadium content (wt ppm) | 79 | 241 | 54.5 | 4.5 |

TABLE 7

| Composition of the Residual Oil from the Mixed Oil | | |
|---|---|---|
| | Content | |
| Residual Oil | vol % | wt % |
| Arabian Light | 47.9 | 48.7 |
| Iranian Heavy | 26.9 | 27.1 |
| Oman | 19.8 | 19.0 |
| Murban | 5.4 | 5.2 |

One Kg of the residual oil obtained from the mixed oil was thermally cracked in the same manner as that in Example 1 to obtain 4 weight % of cracked gases, 68 weight % of cracked oils and 25 weight % of pitch. The cracking was performed for 120 min. The pitch had the properties shown in Table 8.

TABLE 8

| Properties of Pitch | | |
|---|---|---|
| Softening point | (°C.) | 185 |
| Volatile matters | (wt %) | 39.2 |
| Content of fraction boiling at below 300° C. at 60 mm Hg (absolute) | (wt %) | below 1 |
| Metal content (Ni and V) | (wt ppm) | 650 |
| Sulfur content | (wt %) | 5.7 |
| n-Heptane insolubles | (wt %) | 80.9 |
| Quinoline insolubles | (wt %) | 21.8 |

The pitch was found, by polarized light microscopy, to contain mesophase of a mosaic structure. The particle units consitituting the mesophase were found to contain those having a diameter of over 10 μm. The mesophase particles were aggregated with each other to form botryoidal particles having a size of 200–1000 μm and being unevenly dispersed in the pitch. The pitch was found to contain about 30 weight % of mesophase by polarized light microscopy and to have a viscosity of 4000 cp (at 325° C.)

100 g of the pitch was then subjected to filtration in the same manner as described in Example 1. However, it was not possible to completely filter the pitch. Only 10.3 g of filtrate was obtained with the residual liquid being remained unseparated on the metal sieve. The filtrate was revealed to contain mesophase or its aggregated particles having a size of 30 μm or more. The filtrate had a softening point of 181° C., a volatile matter content of 40 weight %, a quinoline insoluble content of 4 weight %, a metal content (V and Ni) of 220 ppm and a viscosity of 870 cp (at 325° C.). The pitch was spun using the same nozzle as used in Example 1 at a spinning temperature of 245° C., a spinning pressure of 1.5 $Kg/cm^2G$ and a spinning rate of 30 m/min. The spinning operation was very difficult to perform because of frequent breakage of the spun fibers during spinning. The spun fibers were found to be difficult to be rendered infusible.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

We claim:

1. A process for the preparation of carbon fibers, comprising the steps of:

subjecting a raw material oil to thermal cracking conditions at a temperature of between 400° and 500° C. while removing cracked, light hydrocarbon components to obtain a pitch product containing 5–40 weight % of mesophase and not more than 10 weight % of light hydrocarbon components with a boiling point at 60 mmHg (absolute) of 300° C. or less and having a softening point of between 140° and 220° C., the raw material oil having a boiling point of at least 500° C. and containing at least 30 weight % of a residual oil which has a boiling point of at least 50° C. and a metal content of at least 200 weight ppm and which is obtained from fractionation of naphthene base and/or intermediate base petroleum crude;

removing the mesophase having a particle size of more than 10 μm from the pitch product to obtain a substantially mesophase-free carbonaceous pitch;

spinning the substantially mesophase-free pitch into fibers;

rendering the spun fibers infusible; and carbonizing the infusible fibers.

2. A process as claimed in claim 1, wherein said thermal cracking is performed in a reaction zone which is maintained under reduced pressure so that the cracked light hydrocarbon components are continuously removed from said reaction zone.

3. A process as claimed in claim 1, wherein said thermal cracking is performed in a reaction zone to which is continuously fed a gaseous heat transfer medium so that the cracked light hydrocarbon components are continuously removed by stripping from said reaction zone.

4. A process as claimed in claim 1, wherein said removing the mesophase is effected by filtration at an elevated temperature.

* * * * *